US005209164A

United States Patent [19]

Durrnagel et al.

[11] Patent Number: 5,209,164

[45] Date of Patent: May 11, 1993

[54] MECHANISM FOR SELECTIVELY ENGAGING THE DOCTOR BLADE WITH THE WASHER ROLLER IN A WASHER FOR A PRINTING PRESS BLANKET CYLINDER

[75] Inventors: Klaus Durrnagel, Taunusstein-Bleidenstadt; Claus Simeth, Geisenheim-Johannisberg, both of Fed. Rep. of Germany

[73] Assignee: MAN Roland Drucksmaschinen AG, Fed. Rep. of Germany

[21] Appl. No.: 893,986

[22] Filed: Jun. 5, 1992

[30] Foreign Application Priority Data

Jun. 6, 1991 [DE] Fed. Rep. of Germany ..... 4118527

[51] Int. Cl.[5] ..... B41F 35/06

[52] U.S. Cl. ..... 101/425; 101/DIG. 47; 101/423

[58] Field of Search ..... 101/423, 424, 424.2, 101/416.1, 425, DIG. 47, 169, 170

[56] References Cited

U.S. PATENT DOCUMENTS

| | | | |
|---|---|---|---|
| 3,521,561 | 7/1970 | Pali et al. | 101/169 |
| 4,328,748 | 5/1982 | Schramm | 101/DIG. 47 |
| 4,782,756 | 11/1988 | Howard | 101/425 |
| 4,870,900 | 10/1989 | Robertson | 101/425 |
| 5,003,876 | 4/1991 | Harrison et al. | 101/425 |

FOREIGN PATENT DOCUMENTS

| | | | |
|---|---|---|---|
| 7005 448 | 2/1970 | Fed. Rep. of Germany . | |
| 3109630 | 2/1982 | Fed. Rep. of Germany | 101/425 |
| 3903434C2 | 2/1991 | Fed. Rep. of Germany . | |
| 59-80356 | 8/1984 | Japan . | |
| 0326104 | 3/1930 | United Kingdom | 101/425 |

OTHER PUBLICATIONS

DE-Z Der Polygraph 21-72, Seite 1512, 1514.

*Primary Examiner*—Edgar S. Burr
*Assistant Examiner*—Lynn D. Hendrickson
*Attorney, Agent, or Firm*—Leydig, Voit & Mayer

[57] ABSTRACT

A mechanism for selectively engaging the doctor blade in a washer for the blanket cylinder of a printing press. The mechanism permits independent control of doctor blade engagement and, through the use of a plurality of adjustably mounted fluid pressure actuators spaced along the length of the doctor blade, facilitates accurate blade alignment, thus preventing non-uniform wear of the doctor blade and the washer roller.

10 Claims, 2 Drawing Sheets

MECHANISM FOR SELECTIVELY ENGAGING THE DOCTOR BLADE WITH THE WASHER ROLLER IN A WASHER FOR A PRINTING PRESS BLANKET CYLINDER

FIELD OF THE INVENTION

The present invention relates generally to devices for washing the blanket cylinders of printing presses. More specifically, the invention concerns a mechanism for controlling the engagement of a doctor blade with the washer roller of a washer for a printing press blanket cylinder.

BACKGROUND OF THE INVENTION

Generally, devices for washing the blanket cylinders of a printing press use a washer roller which has been saturated with detergent to clean the blanket cylinder of a printing press. Often, in order to improve this cleaning action, a doctor blade is provided to clean the washer roller by removing excess detergent and particles from the washer roller. In typical prior washers, because of a single control mechanism, the doctor blade may only engage the washer roller concurrent with the washer roller's engagement of the blanket cylinder. Such a washer mechanism is disclosed in DE-3,903,434 wherein the washer roller engagement mechanism supports and connects to the extreme ends of the doctor blade by two linkage arms.

This engagement mechanism presents several disadvantages. First, the lack of independent control of the doctor blade does not allow for engagement of the doctor blade with the washer roller when the device is not washing the blanket cylinder. Independent control is desirous in that the doctor blade might then be engaged to pre-dampen the washer roller before cleaning or to clean the washer roller after use.

Also, the use of only two linkage arms for supporting the ends of the doctor blade causes uneven distribution along the interface of the doctor blade and the washer roller. This has a tendency to permit deformation or deflection of either the roller or doctor blade and uneven wear of both the roller and the blade.

OBJECTS AND SUMMARY OF THE INVENTION

The primary aim of the present invention is to provide an actuation mechanism to control the engagement of a doctor blade independent of the engagement of the washer roller with the blanket cylinder. An additional object is to provide a doctor blade actuation mechanism which will evenly distribute force over the entire length of the doctor blade to promote uniform wear of both the doctor blade and the washer roller.

The present invention provides a mechanism for selectively engaging a doctor blade in a printing press cylinder washer independent of the control of the entire washer. The present invention additionally provides for adjustable fluid pressure actuating cylinders which evenly distribute their force over the length of the doctor blade and may be individually adjusted to compensate for wear and deflection.

The main advantage of the present invention over prior art is that it allows independent control of the engagement of the doctor blade, thus allowing the doctor blade to be employed in pre-dampening and post-use cleaning of the washer cylinder. A further advantage of the present invention is that the individually adjustable fluid pursue actuation cylinders facilitate continuous longitudinal engagement between the doctor blade and the washer roller and promote uniform wear and stress distribution over the washer roller and doctor blade.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
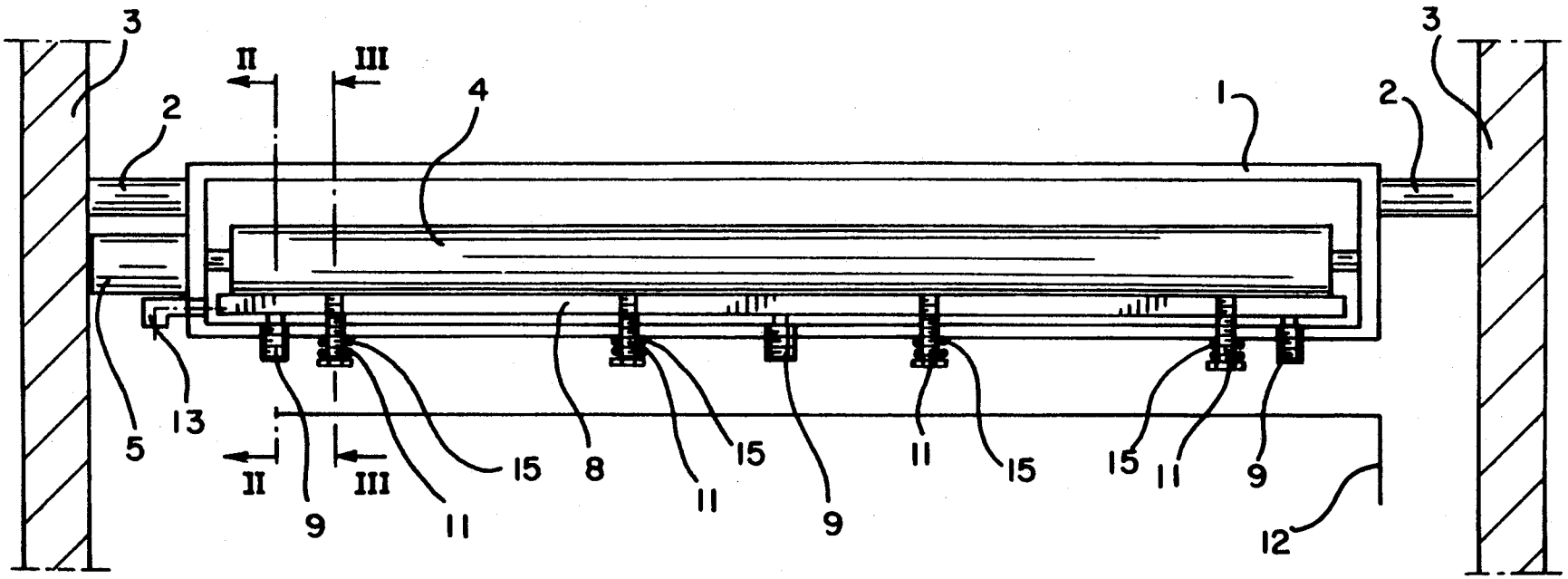
FIG. 1 is a schematic diagram illustrating a washer for a blanket cylinder of the printing press including the selectively engageable doctor blade mechanism of the present invention.
Figure 2:
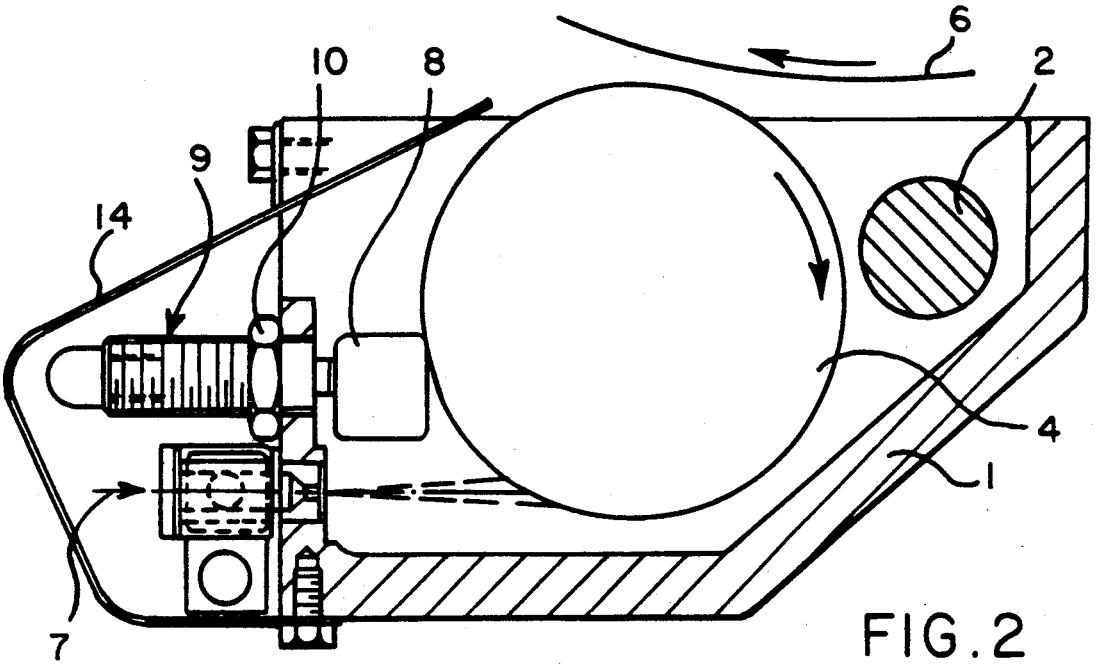
FIG. 2 is an enlarged cross-sectional view substantially as seen along line 2—2 in FIG. 1 showing the washer including the doctor blade engagement mechanism of the present invention with the doctor blade in its engaged position.
Figure 3:
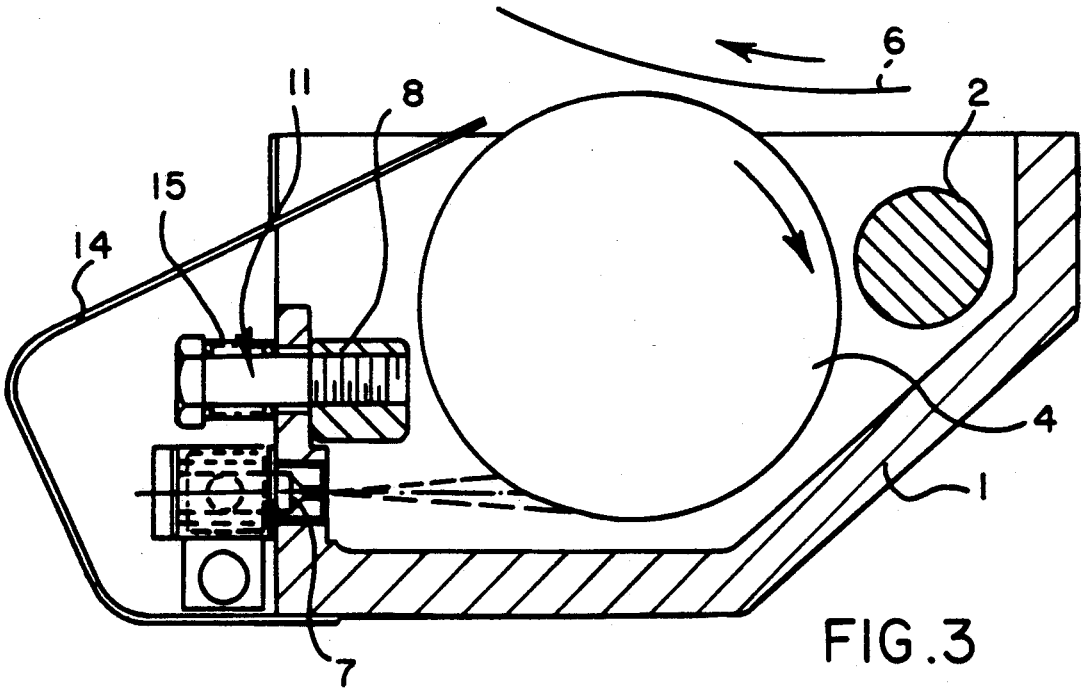
FIG. 3 is a cross sectional view, similar to FIG. 2, substantially as seen along line 3—3 in FIG. 1 showing the washer with the doctor blade in its retracted position.

Turning now to the drawings, a portion of a washer for the blanket cylinder of a printing press is shown in FIGS. 1-3, including the preferred embodiment for the doctor blade engagement mechanism within the washer.

The washer includes an elongated trough 1 mounted for movement by means of a pivot rod 2 on the side frames 3 of the printing press. A washer roller 4 is rotatably mounted in the trough 1 and is driven by a motor 5. To clean the blanket cylinder 6, the trough 1 is pivoted by means (not shown) to engage the washer roller with the blanket cylinder. A plurality of spray nozzles 7 mounted on the trough 1 and disposed in spaced-apart locations along the length of the washer roller 4 spray detergent or washer fluid on the washer roller for cleaning the blanket cylinder 6.

In accordance with the present invention, an elongated doctor blade 8 disposed in the trough 1 is aligned parallel to the axis of the washer roller 4 and engages the washer roller upon pressurization of a plurality of fluid pressure cylinders 9 which are mounted in spaced-apart locations on a substantially vertical front wall of the trough 1. Pursuant to the invention, an external control system (not shown) is provided to adjustably pressurize and depressurize the cylinders 9 independent of the control for engaging of the washer roller 4 with the blanket cylinder 6. In the preferred embodiment, positioning nuts 10 are provided for adjusting the axial position of each cylinder 9 in relation to the vertical wall of the trough 1.

In further keeping with the invention and to guide the doctor blade 8, spring biased guide pins 11 extend through cylindrical bores in the trough wall and screw into tapped holes in the doctor blade. According to the invention, spring means in the form of compression springs 15 surround the guide pins 11 and exert a biasing force between the head of the guide pins and the trough wall.

To actuate the fluid pressure cylinders 9, a common pressure line 12 supplies pressure fluid to the cylinders. Pressurization of the cylinders 9 by suitable control means (not shown) sufficient to overcome the biasing force of the compression springs 15 causes lateral movement of the doctor blade 8 and subsequent engagement with the washer roller 4. The compression springs 15 cause retraction of the doctor blade 8 upon cylinder depressurization.

According to another aspect of the invention, an inlet/outlet fitting 13 communicates with the trough for introducing and draining trough washing and rinsing fluid separate from the spray nozzles 7. As shown in FIGS. 2 and 3, a cover plate 14 is attached to the trough 1 to protect the spray nozzles 7, pressure cylinders 9, and guide pins 11. Preferably, the cover plate 14 extends above the trough 1 toward the nip between the washer roller 4 and the blanket cylinder 6 to prevent washer fluid from splashing out of the trough.

In the preferred embodiment of the invention, the trough 1 is made of metal and the inside surface of the trough is coated with a non-stick plastic material such as polytetrafluoroethylene (TEFLON) in order to inhibit particles of ink and dirt from adhering to the inside surface of the trough 1.

As will be apparent from the foregoing description, the present invention provides an actuation mechanism for engaging a doctor blade with the washer roller independent of the engagement of the washer roller with the blanket cylinder. The adjustable pressurization and the independently adjustable axial positioning of the fluid pressure cylinders allow for close alignment of the doctor blade to achieve parallelism of the doctor blade with the washer roller's cylindrical surface along substantially the entire length thereof.

It will also be appreciated that the fluid pressure actuators 9 may be either hydraulic or pneumatic cylinders supplied by hydraulic fluid or compressed air through the common supply line 12 from a selectively controlled source (not shown). Alternatively, the actuators 9 could be electric solenoids in which case they would be energized with current flowing through the common line 12.

We claim as our invention:

1. A doctor blade actuation mechanism for a blanket cylinder washer of a printing press having a blanket cylinder journalled in the press frame with a washer roller rotatably mounted in an elongated washer trough movably mounted on the press frame for permitting selective engagement of the washer roller with the blanket cylinder and a source of washer fluid communicating with the washer trough for supplying washer fluid to the washer roller, comprising, in combination, an elongated doctor blade disposed in said trough and substantially coextensive in length with said washer roller, a guide means for supporting said doctor blade for movement into and out of engagement with the surface of said washer roller, said guide means including a plurality of guide pins secured to said doctor blade and slidably mounted in said trough in spaced apart locations along the length thereof, and actuating means including a plurality of actuators interposed between said doctor blade and said trough in spaced-apart locations along the length thereof for selectively moving said doctor blade into engagement with said washer roller independent of said selective engagement of said washer roller with said blanket cylinder.

2. A doctor blade actuation mechanism as defined in claim 1 including means for individually adjusting each of said actuators in order to compensate for variations in the spacing between said doctor blade and said washer roller along the length thereof due to differences in wear and deflection therebetween.

3. A doctor blade actuation mechanism as defined in claim 1 wherein said actuators are fluid pressure cylinders and said actuating means includes a common line for supplying fluid pressure to said actuators.

4. A doctor blade actuation mechanism as defined in claim 1 including spring means for biasing said doctor blade out of engagement with said washer roller.

5. A doctor blade actuation mechanism as defined in claim 4 wherein said trough includes a substantially vertical wall through which said guide pins project and said spring means include a plurality of compression springs, each surrounding one of said guide pins, and interposed between said vertical trough wall and the outboard end of said guide pin.

6. A doctor blade actuation mechanism as defined in claim 5 wherein said actuators are fluid pressure cylinders secured to said vertical trough wall, said actuating means includes a common line for supplying fluid pressure to said actuators, and including means for adjusting each of said actuators relative to said vertical trough wall in order to compensate for variations in the spacing between said doctor blade and said washer roller along the length thereof due to differences in wear and deflection therebetween.

7. A doctor blade actuation mechanism as defined in claim 1 wherein said washer fluid source includes a plurality of spray nozzles mounted along the length of said washer trough for spraying washer fluid on said washer roller.

8. A doctor blade actuation mechanism as defined in claim 7 including inlet/outlet means communicating with said trough for introducing and draining trough washing and rinsing fluid separate from said spray nozzles.

9. A doctor blade actuation mechanism as defined in claim 1 wherein said trough is made of metal and the inside surface thereof is coated with a plastic material to inhibit particles of ink and dirt from adhering to the inside surface thereof.

10. A doctor blade actuation mechanism for a blanket cylinder washer of a printing press having a blanket cylinder journalled in the press frame with a washer roller rotatably mounted in an elongated washer trough movably mounted on the press frame for permitting selective engagement of the washer roller with the blanket cylinder and a plurality of spray nozzles mounted along the length of the trough for spraying washer fluid on the washer roller, comprising, in combination, an elongated doctor blade disposed in said trough and substantially coextensive in length with said washer roller, a plurality of guide pins secured to said doctor blade and slidably mounted in said trough in spaced-apart locations along the length thereof, said trough including a substantially vertical wall through which said guide pins project, a plurality of compression springs, each surrounding one of said guide pins, interposed between said vertical trough wall and the outboard ends of said guide pins, a plurality of fluid pressure cylinders adjustably mounted on said vertical trough wall in spaced-apart locations along the length thereof and disposed to bear against said doctor blade, and means including a common line for supplying fluid pressure to said actuators for selectively moving said doctor blade into engagement with said washer roller against the bias of said compression springs and independent of said selective engagement of said washer roller with said blanket cylinder.

* * * * *